United States Patent [19]

Schmidt et al.

[11] 4,143,475

[45] Mar. 13, 1979

[54] SNOW BLOWERS

[75] Inventors: Alfred Schmidt, St. Blasien; Günther Fritz, Wehr, both of Fed. Rep. of Germany

[73] Assignee: Firma Ing. Alfred Schmidt GmbH, Fed. Rep. of Germany

[21] Appl. No.: 848,505

[22] Filed: Nov. 4, 1977

[30] Foreign Application Priority Data

Jun. 8, 1977 [DE] Fed. Rep. of Germany ..... 2725911

[51] Int. Cl.[2] ..... E01H 5/00

[52] U.S. Cl. ..... 37/43 C

[58] Field of Search ..... 37/43 R, 43 A, 43 B, 37/43 C, 43 D, 43 E, 43 F, 43 G, 43 H, 43 I, 43 L, 20–27

[56] References Cited

U.S. PATENT DOCUMENTS

| | | | |
|---|---|---|---|
| 1,959,465 | 5/1934 | Dryfoos | 37/43 R |
| 2,776,505 | 1/1957 | Root | 37/43 B |
| 3,371,434 | 3/1968 | Wandscheer | 37/43 R |
| 3,466,767 | 9/1969 | Rubin | 37/43 R |

FOREIGN PATENT DOCUMENTS

| | | | |
|---|---|---|---|
| 642058 | 2/1937 | Fed. Rep. of Germany | 37/43 B |
| 59501 | 2/1942 | Denmark | 37/43 C |

*Primary Examiner*—E. H. Eickholt

[57] ABSTRACT

A centrifugal snow blower having a frame, a fan rotatable about a central axis supported on the frame and a housing surrounding said fan having a peripheral wall defining at least an opening in direction of clearing and a duct extending tangentially for the ejection of snow. The housing is supported for rotative adjustment about the central axis by a central bearing journaling the housing to said frame, an annular guide member secured to the housing concentric with the central axis and at least one releasable braking device supported on the frame for cooperation with the guide member to fix said housing in selective rotative positions.

10 Claims, 2 Drawing Figures

SNOW BLOWERS

BACKGROUND OF THE INVENTION

The present invention relates to snow blowers and particularly to snow blowers having a surrounding housing provided with an ejection duct for the discharge of the snow, which housing and duct are rotatably adjustable to vary the angle of trajectory of the discharged snow.

In general, snow blowers of this type comprises a centrifugal fan rotatable about a central axis supported on a fixed frame and is surrounded by a housing having a peripheral wall defining an opening in the clearing direction and a tangential discharge duct. In large snow blowers, particularly those which are to be mounted on vehicles, the housing is suspended on journal bearings or rotary ball connections so as to be rotatable, as by a hydraulic or pneumatic drive, through a large angle of swing to permit the throw angle of the discharge duct to be selectively adjustable.

The axial and radial play attendant to such housing suspension systems has an adverse effect on the operation of snow blowers especially on large snow blowers. Large snow masses are accelerated in the housing, by the fan which must revolve at a sufficiently high speed so as to centrifugally throw the snow. As a result, large vibratory forces are set up which are accentuated by the action of the individual blades, each separately propelling a portion of the snow. These vibrations are transmitted to the entire snow blower, including the fore section constituted by the fan and housing and the supporting vehicle in which the power drive mechanisms are located. The extra load on the fore part causes fissures to be easily created in the weld seams, fatigue in the metal parts and other damage to occur. In addition, the impact of the vibration is severe disturbance and presents a stressful situation to the operator of the snow blower.

To counteract the effect of such vibration, it had been previously proposed to fixedly support the housing at at least several points about its periphery. This known proposal is not effective since it provides only an insufficient dampening of the disturbing vibrations, and in addition hinders the ability to adjustably rotate the housing.

By the present invention means are provided for supporting the rotatable housing and snow blower, which overcomes the aforementioned disadvantages, and in particular a suspension means is provided for the housing which effectively supports and suppresses the disturbing vibrations, while permitting simple and easy maneuverability of the housing to its selected position.

A novel and improved coupling means is also provided by the present invention for coupling the rotatable housing of the snow blower to a fixed frame supporting the same.

SUMMARY OF THE INVENTION

According to the present invention the foregoing are obtained by providing a centrifugal snow blower for clearing snow having a frame, a fan rotatable about the central axis supported on the frame, and a housing surrounding the fam having peripheral wall defining at least an opening in the direction of the clearing and a duct extending tangentially therefrom. The housing is supported by means which enables rotative adjustment about the central axis comprising a central bearing journaling the housing to the frame and an annular guide member secured to the housing adjacent its periphery, concentric to the axis of rotation and having at least one releasable braking device supported on the frame for cooperation with the guide member to fix the housing in selective rotative positions.

Preferably the guide member comprises, in cross section, a right angle bracket having at least one leg secured to the back of the housing with the other leg extending therefrom for engagement with the brake means. The brake means preferably comprises a clamping device having a fixed member and a movable member spaced from each other so as to straddle the extending leg of the guide member. The movable clamping member is biased by spring guide member to clamp it between itself and the fixed clamping member.

The brake means is also provided with release means, preferably a fluid actuated rod, which upon pressurization shifts the movable clamping member out of contact with the extending leg thereby permitting simple rotation of the housing.

Full details of the present invention are set forth in the following disclosure of its preferred embodiment, and are illustrated in the accompanying drawyings.

BRIEF DESCRIPTION OF THE DRAWINGS

In the accompanying drawings.

DESCRIPTION OF THE INVENTION

Figure 1:
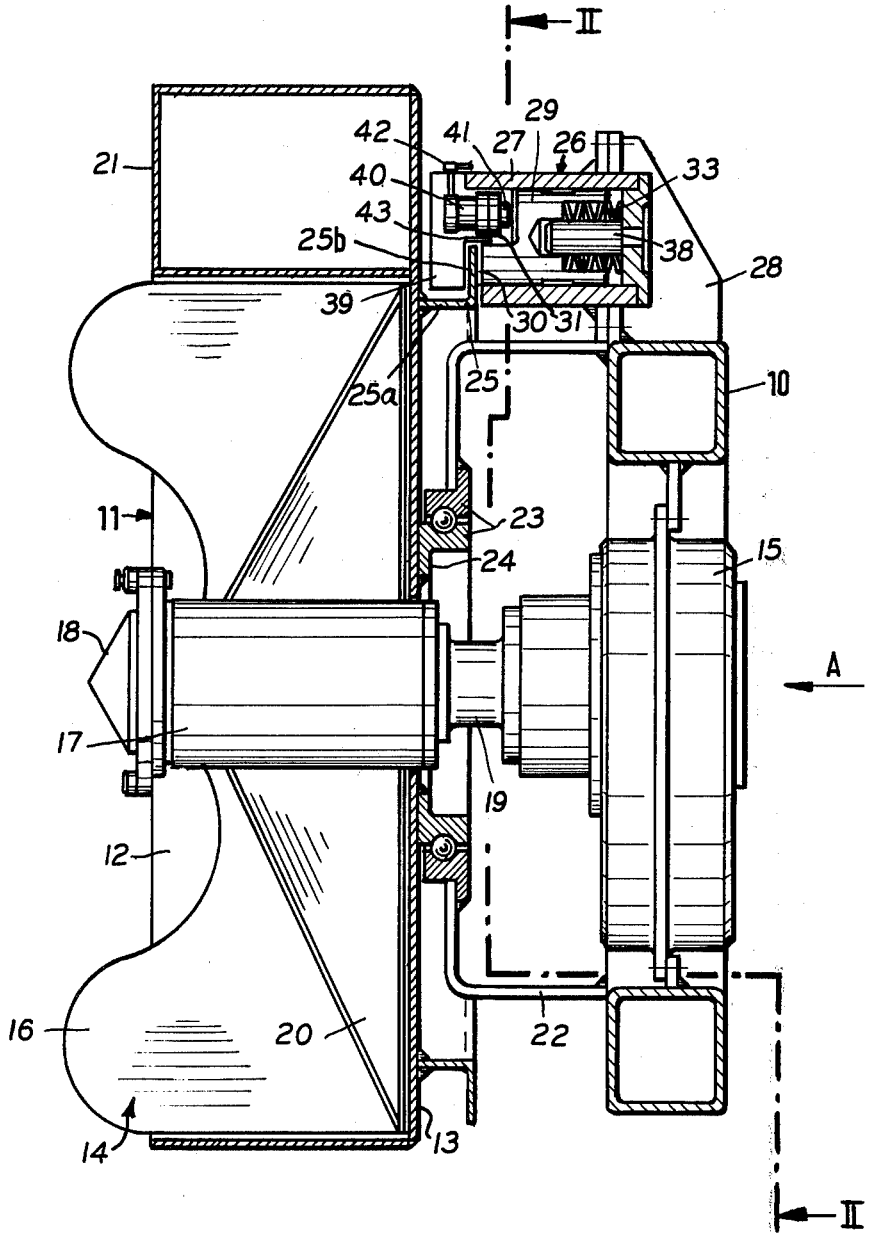
FIG. 1 is a vertical axial section through the snow blower showing the fan, surrounding housing, and the coupling device.

In FIG. 1 only the fore-portion of a snow blower apparatus is illustrated. This fore-portion comprises the frame head 10 which is adapted to permanently or removably secured to a vehicle such as a truck, jeep or the like (not shown) which is propelled in the direction shown by the arrow A, to clear the snow found in its path. Mounted in front of the frame head is a cylindrical ejection housing 11 having an annular peripheral wall 12 and a back wall 13. Within the housing 11 there is rotatably mounted a centrifugal fan 14 driven by a transmission system 15 supported in the frame 10. The back wall 13 of the housing 11 may be solid, or may be made up of a plurality of spokes or rods if desired. The transmission is suitably connected to a power drive such as a motor or engine (not shown) located in the vehicle so that the blower 14 can be rotated as seen by the arrow B in FIG. 2.

The centrifugal blower comprises a plurality of blades 16 each secured at its root to a cylindrical sleeve 17 secured as by keying or bolting to a hub 18 which is connected to the outward shaft 19 of the transmission. The blades 16 are curved or arcuate in compound manner, to sweep and carry axially to the rear of the housing 11 the snow lying in the path of movement of the apparatus. The blower is provided with a conical disk 20 set along the rear wall of the housing 11, which disk deflects the snow captured by the blades from its axial direction to a radial direction and flings the snow outwardly of the ejector housing 11 centrifugally through a chimney or duct 21 which extends tangentially from the interior of the housing. The rotative position of the housing 11 determines the position of the tangential duct 21 and thus the trajectory of the snow leaving the housing. Thus, the housing must be arranged so as to be adjustable about the central shaft 19 so that the position of the duct may be easily and selectively varied.

To effect the aforementioned adjustability, the housing 11 is mounted on a cup or shell shaped bracket 22 via a radial ball bearing journal 23 one race of which is secured to a central hub 24 welded to the back wall 13 of the housing concentrically to the axis 19 while the other race is welded to the shell 22 also concentric to the axis 19. Such a bearing which is of large diameter, coupled with the large housing, developes a certain degree of radial and axial play, which as a result of the uneven distribution of the snow about the ejector housing produces unwanted vibration. To overcome the effects of the vibration, and to reduce the aforementioned play, and to fix the ejector housing relative to the frame after its adjustment, a peripheral coupling system is provided.

Figure 2:
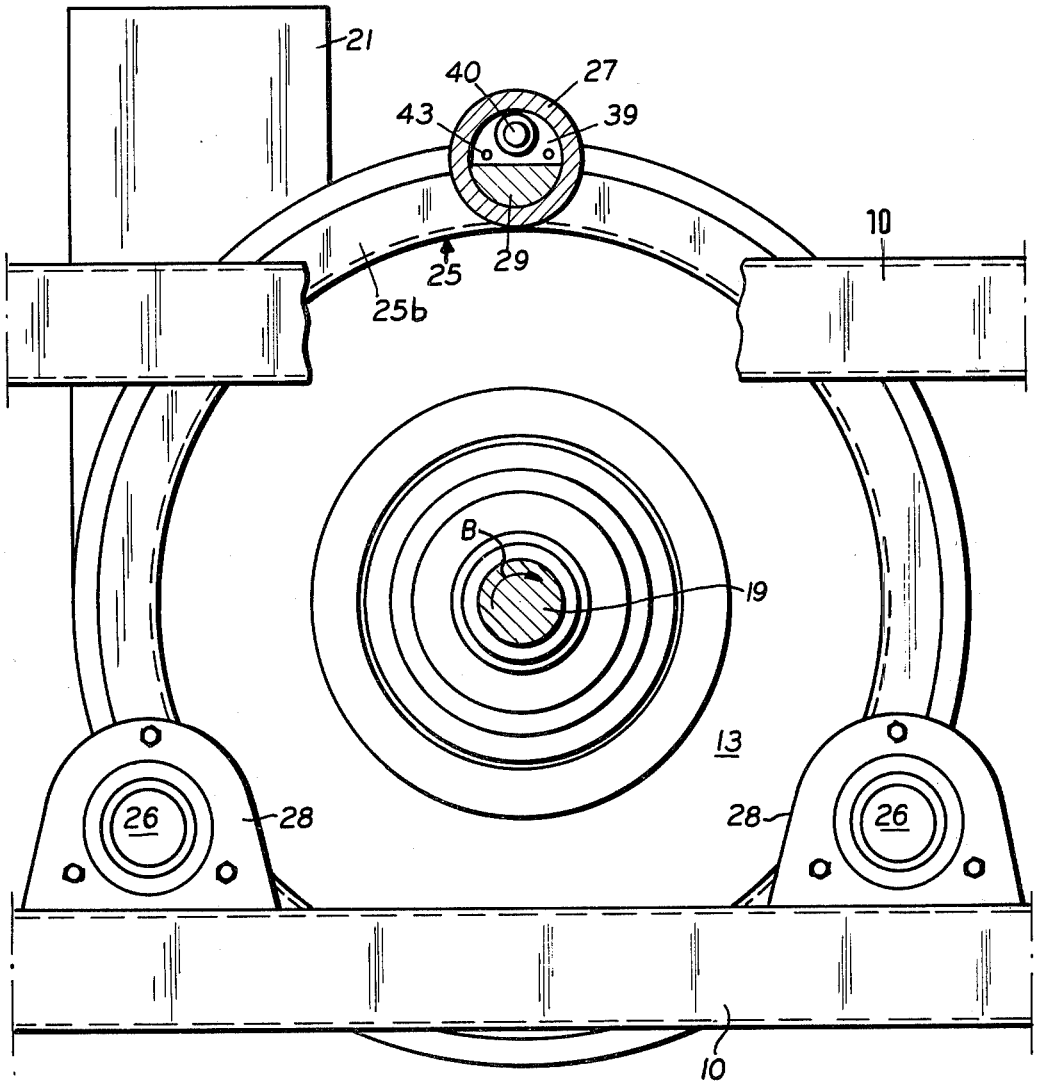
FIG. 2 is a section taken along the line II—II of FIG. 1.

The coupling systems comprises an annular guide member 25 which in cross section takes the form of a right angle iron having the edge of one arm **25*a* welded to the back of the housing 11 adjacent to its periphery and another arm 25*b* extending outwardly of the housing and parallel to the back wall 13. This second arm 25*b* engages within a plurality of resiliently formed braking members 26 arranged equidistant from each other about the periphery. Preferably three of these devices arranged at 120 degrees from each other, have been found most suitable, as seen in FIG. 2**, although the number can be varied as desired.

The resilient braking devices 26 are in the nature of a clamping system comprising a generally tubular housing 27 fixedly secured to a bracket 28 which is itself fixedly secured to the frame head 10 by welding. Located within the tubular housing 27 is a piston 29 having cut down front portion 30 providing a shoulder and a recessed wall 31. The piston 29 is biased by a plurality of springs 33, such as a multiple arrangement of Belleville springs, so as to be normally pushed outwardly of the tube 27 in the direction of the housing 11. The springs 33 are centered on a stud 38 welded to the back wall of the tube. The stud 38 also enters into a bore formed in the piston so as to center and guide the piston. Fixedly mounted at the forward end of the tube 27 is a fixed clamping member or anvil 39. The piston 29 and the fixed member or anvil 39 are formed so as to provide a space or gap in which the extending leg **25*b* of the guide member fits so that the face 30 of the piston 29 and the face of the fixed clamping anvil 39 lie in opposition to the respective surfaces of the leg 25*b*. By thus placing the movable piston in opposition to the rear face of the leg 25*b*** and fixing the corresponding end of the tube, to the rail, a great force may be applied to the guide member, while maintaining the size of the braking mechanism as small as possible.

In a bore formed in the fixed clamping member of anvil 39 radially outward of the edge of the arm **25*b* of the guide member there is located a fluid operated motor device 40 having a movable rod 41 which is extendable axially toward and away from the spring biased piston 29. Preferably the fluid actuated device 40 is hydraulically controlled and it is therefore connected to a source of pressurized fluid such as hydraulic oil or the like, through a conduit 42 and is provided with suitable valving and control means so as to be selectively pressurized or depressurized. Such controls may be connected to the cab of the vehicle so as to be easily actuated by the operator. Upon pressurization of the fluid actuated device, the rod 41 is caused to move axially to the rear into contact with piston 29**.

To permit rotation of the housing 10 the fluid motor 40 is pressurized pushing the normally biased piston 29 out of contact with the guide member 25. As shown in FIG. 1, the hydraulic device is relieved of pressure and the rod 41 is retracted into its bore in the fixed anvil member 39. In this position the piston 29 is free to be pushed by the spring 33 into contact with the rear face of the extending leg of **25*b* of the guide member. In this manner the pressure exerted by the piston 29 causes the guide member to be gripped and clamped against the fixed member or anvil 39**.

While a certain degree of flexibility and elasticity is inherent in this construction as a result of the use of the springs 33 normally biasing the piston 29, the clamping device thus described assures a stable and fixed connection during normal operation between the housing 11 and the frame 10 successfully eliminating play and fully dampening vibration. On the other hand, in order to change the position of the housing and the duct 21 as well, it is only necessary to pressurize the fluid actuated device 40, so that the rod 41 is extended pushing the piston 29 counter to the springs 33. This releases the extending leg **25*b* permitting the housing to be rotated. It is, of course, understood that it is preferable to interconnect the clamping members so that the individual fluid actuated devices 40 are simultaneously pressurized and simultaneously controlled so that the housing is released completely about its periphery, when rotation is desired. In order to assure that piston 29 remains in its fixed position in contact with the guide member 25, the fixed member or anvil 39 is provided with a pair of laterally spaced pins 43 located just below the fluid actuated rod 41 (see FIG. 2) which project over the flat shoulder portion of the piston. Because of the spacing of these pins, rotation of the piston 29** about its own axis is effectively prevented.

From the foregoing it will be seen that it is important to the solution found by the present invention to establish a practical rigid clamping or braking connection between the frame 10 and the housing 11 surrounding the centrifugal blower itself. This is obtained by the creation of the guide member 25 connected to the housing, concentric with the axis of rotation but spaced adjacent the periphery thereof. The guide member is itself a simple design being of an angle iron form commonly used in many other structural uses. Such an angle iron provides tortional stiffness to the housing, particularly as it is welded to the back thereof. The particular braking device providing a clamping means which is connected to the frame of the apparatus is designed so that even upon failure to the devices for actuation and control thereof, a vibration free seating or holding of the frame is insured. This is effective by providing the braking piston with spring biasing means as a result of which the housing is secured against uncontrolled rotation even at rest as well as during the movement of the snow masses through it. Instrumental in this effect is the use of a packet or assembly of springs, such as of the Belleville type, which will continue throughout operation to exert its force.

This stability of the suspension of the rotatable housing is increased in that preferably three clamping devices are arranged uniformly over the circumference. As indicated, the release of the clamping devices may be controlled by suitable electric or hydraulic controls. The pivotal movement of the housing itself can be synchronized with proper controls, and can be driven preferably by a hydraulic drive such as a cylinder or hydraulic motor, or even an electric motor, with suitable rachet and pinion construction, which itself need not be described here. Such hydraulic motor can be controlled from the interior of the cab, and with a suitable connecting means, cause the housing 11 to index or continuously rotate about the central axis, to any selected position. By synchronization of the clamping device with the moving rotating device rotation can be effected only in the interval when the clamping device is released from the guide member.

From the foregoing it will be easily seen that the present invention provides a simple and effective apparatus to obtain the desired solutions mentioned earlier. It is also obvious, that various modifications have been described. Other modifications, embodiments and changes are obvious to those skilled in the present art. Accordingly, the present disclosure is not to be taken as limiting of the present invention but only as illustrative therefor.

What is claimed is:

1. A centrifugal snow blower for clearing snow comprising a frame, a fan rotatable about a central axis supported on said frame and a housing surrounding said fan having a peripheral wall defining at least an opening in direction of clearing and a duct extending tangentially for the ejection of snow therefrom, means for supporting such housing for rotative adjustment about the central axis comprising a central bearing journaling said housing to said frame, an annular guide member secured to said housing concentric with the central axis and at least one releasable braking device supported on said frame for cooperation with said guide member to fix said housing in selective rotative positions.

2. The snow blower according to claim 1 wherein said housing is provided with a central hub extending rearwardly of the opening about the central axis and a radial ball bearing, one race of which is formed by said hub, the other race of which is connected to said frame.

3. The snow blower according to claim 1, wherein said guide member comprises in cross section a right angle bracket having at least one leg secured to said housing and the other leg extending spaced therefrom for engagement by said braking means.

4. The snow blower according to claim 3, wherein said braking device comprises a spring biased clamp adapted to frictionally contact said extending leg.

5. The snow blower according to claim 4, wherein said clamp comprises a fixed member and a movable member, said fixed and movable members being arranged in opposition to each other to provide a gap therebetween for entry of the extending leg of said guide member, and spring means for normally urging said movable member toward said fixed member to thereby normally clamp said extending leg of said guide member therebetween.

6. The snow blower according to claim 5 wherein said clamping means includes release means for selectively shifting said movable member in opposition to said spring means to free the movable member from contact with the extending leg.

7. The snow blower according to claim 6, wherein said release means comprises fluid actuated rod housed in said fixed clamping member, said rod being adapted on pressurization to engage and shift said movable clamping member from contact with the extending leg.

8. The snow blower according to claim 5, wherein said movable clamping member is arranged to engage the side of said extending leg away from said housing.

9. The snow blower according to claim 7, wherein said fluid actuated release rod is arranged within a bore in said fixed clamping member.

10. The snow blower according to claim 5, wherein said fixed and movable clamping members are housed in a tubular member secured to the frame.

* * * * *